US011624365B2

(12) United States Patent
Pippes et al.

(10) Patent No.: US 11,624,365 B2
(45) Date of Patent: Apr. 11, 2023

(54) FLUID DELIVERY DEVICE

(71) Applicant: ECKERLE TECHNOLOGIES GMBH, Malsch (DE)

(72) Inventors: Reinhard Pippes, Bretten-Sprantal (DE); Artur Bohr, Stuttgart (DE)

(73) Assignee: ECKERLE TECHNOLOGIES GMBH, Malsch (DE)

( * ) Notice: Subject to any disclaimer, the term of this patent is extended or adjusted under 35 U.S.C. 154(b) by 0 days.

(21) Appl. No.: 17/261,910

(22) PCT Filed: Jul. 23, 2019

(86) PCT No.: PCT/EP2019/069825
§ 371 (c)(1),
(2) Date: Jan. 21, 2021

(87) PCT Pub. No.: WO2020/020902
PCT Pub. Date: Jan. 30, 2020

(65) Prior Publication Data

US 2021/0285448 A1 Sep. 16, 2021

(30) Foreign Application Priority Data

Jul. 26, 2018 (DE) ..... 10 2018 212 497.3

(51) Int. Cl.
*F03C 2/00* (2006.01)
*F03C 4/00* (2006.01)
(Continued)

(52) U.S. Cl.
CPC ..... *F04C 23/005* (2013.01); *F04C 2/101* (2013.01); *F04D 13/12* (2013.01)

(58) Field of Classification Search
CPC .... F04C 23/001; F04C 23/003; F04C 23/005; F04C 11/001; F04C 11/003; F04C 11/005;
(Continued)

(56) References Cited

U.S. PATENT DOCUMENTS 3,532,441 A 10/1970 Schofield
6,179,595 B1 * 1/2001 Buchmuller ..... F04C 2/101 418/170
(Continued)

FOREIGN PATENT DOCUMENTS

CN 101855452 A 10/2010
CN 103620222 A 3/2014
(Continued)

OTHER PUBLICATIONS

International Search Report (in English and German) and Written Opinion of the ISA (in German) issued in PCT/EP2019/069825; ISA/EP.
(Continued)

*Primary Examiner* — Theresa Trieu
(74) *Attorney, Agent, or Firm* — Harness, Dickey & Pierce, P.L.C.; Stephen T. Olson

(57) ABSTRACT

A fluid delivery device has a primary pump and a main pump fluidically connected to the primary pump. The primary pump can be driven by a primary pump input shaft, the main pump can be driven by a main pump input shaft, and the primary pump input shaft and the main pump input shaft are mechanically coupled to a common drive shaft of the fluid delivery device. The primary pump is in the form of a non-compensated gear pump or a centrifugal pump and the main pump is in the form of a compensated internal gear pump.

13 Claims, 4 Drawing Sheets

(51) Int. Cl.

| | |
|---|---|
| ***F04C 2/00*** | (2006.01) |
| ***F04C 23/00*** | (2006.01) |
| ***F04C 2/10*** | (2006.01) |
| ***F04D 13/12*** | (2006.01) |

(58) Field of Classification Search
CPC ..... F04C 2/101; F04C 2/102; F04C 15/06; F04C 18/103; F04D 13/01; F04D 17/08; F04D 17/12
See application file for complete search history.

(56) References Cited

U.S. PATENT DOCUMENTS

| | | | | |
|---|---|---|---|---|
| 9,175,680 | B2 | 11/2015 | Miyaki et al. | |
| 2009/0297363 | A1 | 12/2009 | Killion | |
| 2010/0119383 | A1 | 5/2010 | Merz et al. | |
| 2012/0244028 | A1* | 9/2012 | Schepp | F04C 2/101 418/170 |
| 2014/0086778 | A1 | 3/2014 | Speer et al. | |
| 2014/0377115 | A1 | 12/2014 | Biehler et al. | |

FOREIGN PATENT DOCUMENTS

| | | | | | |
|---|---|---|---|---|---|
| CN | 104806468 | A | | 7/2015 | |
| CN | 104806468 | A | | 7/2015 | |
| DE | 19647052 | C2 | | 6/1999 | |
| DE | 19950206 | A1 | | 4/2001 | |
| DE | 10159147 | A1 | * | 6/2003 | F04C 11/001 |
| DE | 10352029 | A1 | | 6/2005 | |
| DE | 10352029 | A1 | | 6/2005 | |
| DE | 102005004657 | A1 | * | 8/2006 | F04C 15/0026 |
| DE | 102007032103 | A1 | | 11/2008 | |
| DE | 112009001302 | T5 | | 4/2011 | |
| DE | 202013103826 | U1 | | 9/2013 | |
| DE | 102012217484 | A1 | | 3/2014 | |
| DE | 102013211615 | A1 | | 12/2014 | |
| JP | 5893976 | A | | 6/1983 | |
| JP | 5893977 | A | | 6/1983 | |
| JP | S5893976 | A | | 6/1983 | |
| JP | S5893977 | A | | 6/1983 | |
| JP | 04111586 | U | | 9/1992 | |
| JP | H04111586 | U | | 9/1992 | |
| JP | 10047279 | A | * | 2/1998 | F04C 23/001 |
| JP | 2015059566 | A | | 3/2015 | |
| JP | 2015059566 | A | | 3/2015 | |

OTHER PUBLICATIONS

German International Preliminary Report on Patentability, dated Oct. 22, 2020, with English Translation.
International Preliminary Report on Patentability received for the PCT Application No. PCT/EP2019/069825, dated Jan. 28, 2020, 9 pages.
Office Action received in corresponding Chinese Application No. 201980049877.0 dated Apr. 6, 2022.

* cited by examiner

FLUID DELIVERY DEVICE

CROSS-REFERENCE TO RELATED APPLICATIONS

This application is a U.S. National Phase Application under 35 U.S.C. 371 of International Application No. PCT/EP2019/069825, filed Jul. 23, 2019, which claims the benefit of German Patent Application No. 10 2018 212 497.3, filed Jul. 26, 2018. The entire disclosures of the above applications are incorporated herein by reference.

FIELD

The invention relates to a fluid delivery device having a primary pump and a main pump fluidically connected to the primary pump, wherein the primary pump can be driven by a primary pump input shaft, and the main pump can be driven by a main pump input shaft, and the primary pump input shaft and the main pump input shaft are mechanically coupled to a common drive shaft of the fluid delivery device.

BACKGROUND

For example, DE 10 2007 032 103 A1 is known from the prior art. It relates to a pump unit with a main pump and a charging pump with a variable pump capacity. A lifting ring is provided for varying the capacity of the charging pump. A regulating power, which depends on the inlet pressure of the main pump, acts on the lifting ring.

SUMMARY

The problem addressed by the invention is that of proposing a fluid delivery device which has advantages over known fluid delivery devices, particularly realizing a high delivery rate at simultaneous high efficiency.

According to the invention, this problem is solved by a fluid delivery device having a primary pump in the form of a non-compensated gear pump or a centrifugal pump and a main pump is in the form of a compensated internal gear pump.

The fluid delivery device is used to deliver a fluid, for example, a liquid or a gas. For this purpose, the fluid delivery device has the primary pump and the main pump, wherein the main pump is fluidically connected to the primary pump. This means that the fluid is first fed to the primary pump, which delivers the fluid in the direction of the main pump. The fluid delivered by the primary pump is thus made available to the main pump which delivers the fluid, namely, for example, in the direction of a fluid outlet of the fluid delivery device, which can also be called a delivery device fluid outlet.

Each of the pumps has an input shaft, via which it can be driven, i.e., the primary pump can be driven via the primary pump input shaft and the main pump via the main pump input shaft. The primary pump also has two wheels to deliver the fluid, namely the primary pump sprocket and the primary pump hollow wheel. The primary pump sprocket has an external toothing and the primary pump hollow wheel has an internal toothing. The external toothing and the internal toothing mesh with one another in regions, i.e., they intermesh. The primary pump sprocket and the primary pump hollow wheel are provided for fluid delivery and for this reason are configured such that, in the case of a rotary movement of the primary pump input shaft, they interact to deliver the fluid and for this purpose, for example, mesh with one another or intermesh.

The primary pump sprocket is coupled to the primary pump input shaft, preferably in a rigid and/or permanent manner. In this case, the primary pump sprocket is preferably arranged on the primary pump input shaft, so that it always has the same speed as the primary pump input shaft during operation of the primary pump. The primary pump input shaft is coupled to the common drive shaft in a driving manner, preferably again in a rigid and/or permanent manner. For example, the primary pump input shaft is integral with the common drive shaft, so that the primary pump input shaft is formed by the drive shaft and/or vice versa. In this respect, the primary pump can be driven directly and immediately via the drive shaft.

In an analogous manner, the main pump has the main pump sprocket and the main pump hollow wheel. The main pump sprocket has an external toothing and the main pump hollow wheel has an internal toothing. The external toothing and the internal toothing mesh with one another in regions, i.e., they intermesh. The main pump sprocket and the main pump hollow wheel are in turn provided for fluid delivery and are configured such that, in the case of a rotary movement of the main pump input shaft, they interact to deliver the fluid and for this purpose, for example, mesh with one another or intermesh.

It can be provided that the main pump input shaft, analogously to the primary pump input shaft, is coupled to the common drive shaft in a driving manner, preferably rigidly and/or permanently. For example, the pump input shaft is integral with the common drive shaft, so that the main pump input shaft is formed by the drive shaft and/or vice versa. In this respect, the main pump can be driven directly and immediately via the drive shaft. Particularly preferably, it is provided that both the primary pump input shaft and the main pump input shaft are formed by the common drive shaft. In other words, the primary pump input shaft is integral with, and/or made of the same material as, the main pump input shaft, so that together, they form the drive shaft. Accordingly, the primary pump input shaft and the main pump input shaft are arranged coaxially to one another. In such a configuration, the primary pump and the main pump are always operated at the same speed.

Alternatively, it can be provided that the main pump can only be driven indirectly via the drive shaft. For this purpose, the main pump is connected to the drive shaft in a driving manner via the primary pump, so that, in the case of a rotary movement of the drive shaft, the main pump is driven via the primary pump. The primary pump sprocket and the primary pump hollow wheel are preferably connected to one another in a driving manner. This means that the primary pump sprocket is provided and configured to drive the primary pump hollow wheel, so that, in the case of a rotary movement of the primary pump input shaft, both the primary pump sprocket and the primary pump hollow wheel rotate.

The primary pump hollow wheel is now connected to the main pump input shaft in a driving manner, namely via a connecting shaft. In other words, the main pump is connected to the primary pump hollow wheel in a driving manner, so that, preferably in the case of a rotary movement of the primary pump hollow wheel, the main pump input shaft also rotates. The main pump input shaft and the connecting shaft can be configured separately or to be integral. In the latter case, the main pump input shaft forms the connecting shaft and/or vice versa. For example, the primary pump hollow wheel is rotatably mounted by means of the connecting shaft and/or the main pump input shaft.

This means that the fluid delivery device in this embodiment is configured such that the primary pump input shaft is coupled directly and immediately to the drive shaft. However, the main pump input shaft is only indirectly coupled to the drive shaft via the connecting shaft and/or the primary pump. Such an embodiment of the fluid delivery device has the advantage that the speed of the primary pump and the main pump or the respective input shaft are in a fixed relationship with one another, so that, for example, there is a specific ratio between the speeds, and the two pumps are operated with different speeds. As a result, very good coordination between the primary pump and the main pump is achieved during the operation of the fluid delivery device.

In any case—i.e., regardless of the connection of the primary pump and the main pump to the drive shaft—the primary pump is in the form of a non-compensated gear pump or a centrifugal pump and the main pump is in the form of a compensated internal gear pump. In one embodiment, both pumps, i.e., both the primary pump and the main pump, are configured as gear pumps, wherein the primary pump is preferably in the form of an internal gear pump or an external gear pump and the main pump is in the form of an internal gear pump. The main pump is axially and/or radially compensated. In another embodiment, the primary pump is in the form of a centrifugal pump and the main pump is in the form of an internal gear pump. The main pump is once again axially and/or radially compensated. It can be provided that the main pump is axially compensated and radially non-compensated, axially non-compensated and radially compensated or both axially compensated and radially compensated. Axial compensation means that, as seen looking in the axial direction with regard to the respective internal gear pump, an axial disk is arranged between the sprocket and the hollow wheel of the internal gear pump.

The axial disk can be moved in the axial direction with little play. During the operation of the respective gear pump or internal gear pump, said axial disk is pushed in the axial direction in the direction of the sprocket and the hollow wheel and preferably at least temporarily, particularly continuously, bears against them. One such axial disk each is particularly preferably located in the axial direction on opposite sides of the sprocket and the hollow wheel. For example, the axial disks are each arranged between the sprocket and the hollow wheel and a machine housing of the main pump, i.e., at the front of the sprocket and the hollow wheel. Insofar as only one axial disk is referenced below, the statements can always be transferred to each of the multiple axial disks, if provided.

The axial disk is preferably non-rotatably mounted in the machine housing. On its side facing away from the sprocket and the hollow wheel and, in this respect, on the side facing the machine housing, it can have a pressure field which is designed, for example, in the form of a recess in the axial disk. Pressurized fluid can be applied to the pressure field via a fluid channel which is formed in the machine housing. For example, the pressure field is fluidically connected to a pressure side of the gear pump or internal gear pump via the fluid channel. During operation of the gear pump or internal gear pump, pressure is applied to the pressure field via the fluid channel such that the axial disk is accordingly pushed in the axial direction in the direction of the sprocket and the hollow wheel, particularly pushed against the sprocket and the hollow wheel.

Additionally or alternatively to the axial compensation, the radial compensation of the internal gear pump is provided. The internal gear pump has a filler piece which, as seen looking in the radial direction with respect to a rotational axis of the sprocket, is arranged between the sprocket and the hollow wheel. The filler piece is used to fluidically separate a pressure side from a suction side of the internal gear pump or a pressure chamber from a suction chamber, which are also formed in the radial direction between the sprocket and the hollow wheel. In the case of radial compensation, the filler piece has a multipiece design and a first filler piece part which bears against the sprocket, and a second filler piece part which bears against the hollow wheel. The two filler piece parts are movable relative to one another in the radial direction and are configured such that the first filler piece part is pushed in the radial direction inwardly against the sprocket and the second filler piece part is pushed in the radial direction outwardly against the hollow wheel. As a result, an excellent sealing between the pressure chamber and the suction chamber is achieved over the running time of the internal gear pump.

For example, a pressure chamber lying in the radial direction between the first filler piece part and the second filler piece part is fluidically connected to the pressure side of the internal gear pump, so that the pressure chamber is pressurized during operation of the internal gear pump. Due to the application of pressure, force is applied to the two filler piece parts in the radial direction, so that the first filler piece part is pushed in the direction of or against the sprocket and the second filler piece part is pushed in the direction of or against the hollow wheel. It is therefore preferably provided for the axial compensation and/or the radial compensation of the internal gear pump that this takes place on the basis of a pressure on the pressure side of the internal gear pump. The greater the pressure on the pressure side of the internal gear pump, the greater the sealing effect achieved by means of the axial disk and/or the filler piece.

It was already stated above that the main pump can be configured with axial compensation, with radial compensation, or both with axial compensation and with radial compensation. By contrast, the primary pump configured as a gear pump is partially non-compensated, i.e., it is either axially non-compensated or radially non-compensated. Particularly preferably, it is both axially non-compensated and radially non-compensated. For example, the primary pump does not have the same compensation that the main pump has. Therefore, if the main pump is axially compensated and radially non-compensated, the primary pump is axially non-compensated and radially compensated. However, if the main pump is axially non-compensated and radially compensated, the primary pump is axially compensated and radially non-compensated. If the main pump is axially compensated and radially compensated, the primary pump is axially non-compensated and radially non-compensated. If the primary pump is configured as an external gear pump, the sprocket, in the context of this description, is replaced by a first gear and the hollow wheel is replaced by a second gear, which meshes with the first gear for delivering the fluid. The centrifugal pump can be configured as a radial pump, diagonal pump, side channel pump, peripheral gear pump, or axial pump. With such a configuration of the fluid delivery device, very high speeds of at least the primary pump, but preferably also of the main pump, can be achieved, so that overall the fluid delivery device is designed for extremely high fluid throughputs.

A further embodiment of the invention provides that the primary pump configured as an internal gear pump has a primary pump sprocket and a primary pump hollow wheel and the main pump has a main pump sprocket and a main pump hollow wheel, wherein the primary pump sprocket and the main pump sprocket are arranged coaxially to one another and the primary pump hollow wheel and the main pump hollow wheel are arranged to be axially offset from one another. The statements on the main pump can naturally also be used for the primary pump configured as a centrifugal pump. The primary pump sprocket is rotatably mounted about a rotational axis of the primary pump sprocket, the primary pump hollow wheel is rotatably mounted about a rotational axis of the primary pump hollow wheel, the main pump sprocket is rotatably mounted about a rotational axis of the main pump sprocket, and the main pump hollow wheel is rotatably mounted about a rotational axis of the main pump hollow wheel. The rotational axes of the sprocket and the hollow wheel of both the primary pump and the main pump are arranged axially offset from one another, so that their rotational axes are arranged parallel to one another and spaced apart. One embodiment of the fluid delivery device is preferred, in which the primary pump sprocket and the main pump sprocket are arranged coaxially to one another, so that their rotational axes coincide with one another or are identical. However, the primary pump hollow wheel and the main pump hollow wheel should be arranged axially offset from one another, so that the rotational axis of the primary pump hollow wheel and the rotational axis of the main pump hollow wheel lie parallel to one another and spaced apart. This allows for a particularly advantageous fluid guidance between the primary pump and the main pump.

Alternatively, it can naturally also be provided that the primary pump sprocket and the main pump sprocket are arranged coaxially to one another, and the primary pump hollow wheel and the main pump hollow wheel can also be arranged coaxially to one another. In this case, the rotational axis of the primary pump sprocket and the rotational axis of the main pump sprocket coincide. This also applies to the rotational axis of the primary pump hollow wheel and the rotational axis of the main pump hollow wheel. In any case, it can be provided that the primary pump sprocket and the main pump sprocket have identical dimensions in the radial direction. The primary pump sprocket and the main pump sprocket are particularly preferably configured to be structurally identical or identical. Additionally or alternatively, the primary pump hollow wheel and the main pump hollow wheel have identical dimensions in the radial direction. They are particularly preferably designed to be structurally identical or identical. The dimensions of the sprockets refer to the dimensions of their outer circumference, and the dimensions of the hollow wheels refer to the dimensions of their inner circumference. In other words, the dimensions of the sprockets and the hollow wheels correspond to the respective tip diameter of the corresponding toothing, i.e., the external toothing of the sprockets and the internal toothing of the hollow wheels.

Particularly preferably, it is provided that teeth of the primary pump sprocket and the main pump sprocket and/or teeth of the primary pump hollow wheel and the main pump hollow wheel are arranged offset from one another in the circumferential direction, for example, by half a tooth distance. As a result, pulsations in the fluid delivery device can be avoided.

A further embodiment of the invention provides that the primary pump has a higher limit speed than the main pump, and/or that the primary pump has a larger pump volume than the main pump. Due to the at least partially or completely missing compensation of the primary pump, it is better suited for higher limit speeds than the compensated main pump. Such a configuration of the fluid delivery device ensures that the main pump is always optimally supplied with fluid from the primary pump. Additionally or alternatively, the primary pump has the larger pump volume in comparison with the main pump. The pump volume can also be called the geometric delivery volume. This, in turn, describes a delivery volume of the respective pump during one revolution of the respective input shaft, i.e., of the primary pump input shaft for the primary pump and of the main pump input shaft for the main pump. The geometric delivery volume neglects tolerances, play and deformations that can occur during operation of the respective pump. The larger pump volume of the primary pump allows for a permanently reliable application of the fluid to the main pump.

Within the scope of a further embodiment of the invention, it is provided that the primary pump and the main pump are arranged in a common machine housing. This has the advantage of a simple, cost-effective production of the fluid delivery device. For example, the machine housing is configured such that the primary pump sprocket and the primary pump hollow wheel, as seen looking in the axial direction, are introduced into the machine housing from one side and the main pump sprocket and the main pump hollow wheel are introduced from the other side when the fluid delivery device is assembled. In this respect, a partition is arranged in the machine housing, which, at least in regions, fluidically separates the primary pump and the main pump from one another. In any case, the primary pump and the main pump are preferably arranged adjacent, particularly at a distance, from one another in the axial direction, i.e., without overlapping as seen looking in the axial direction, in the machine housing.

A further preferred embodiment of the invention provides that a suction chamber of the primary pump configured as an internal gear pump extends over a larger angular range than a suction chamber of the main pump, and/or that a pressure chamber of the primary pump extends over at least the same angular range as a pressure chamber of the main pump. The suction chamber and the pressure chamber, as seen in cross section, are located in the radial direction between the sprocket and the hollow wheel of the respective pump. In other words, the suction chamber and the pressure chamber are each delimited inwardly in the radial direction by the sprocket and outwardly in the radial direction by the hollow wheel. The sprocket and the hollow wheel of the respective pump are configured such that they deliver fluid located in the suction chamber in the direction of the pressure chamber.

For example, the fluid is fed to the suction chamber in the axial direction and/or in the radial direction. For example, at least one inlet channel is formed in the machine housing for feeding the fluid in the axial direction. For a feeding in the radial direction, the respective hollow wheel has at least one recess which at least temporarily opens into the suction chamber. The fluid can be removed from the pressure chamber in the axial direction and/or in the radial direction. An outlet channel is formed in the machine housing for removal in the axial direction. For a removal in the radial direction, the hollow wheel has the recess, which, at least temporarily, has a flow connection to the pressure chamber. In this respect, a flow connection between the pressure chamber and the outlet channel or an outlet of the fluid delivery device is at least temporarily established via the recess.

As seen in cross section, the suction chamber of the primary pump extends over a larger angular range than the suction chamber of the main pump. This is achieved particularly by a different configuration of the filler piece which, for the primary pump, is smaller in the circumferential direction than for the main pump. Due to the larger extension of the suction chamber of the primary pump, a high speed of the primary pump becomes possible because, due to the greater distance available for filling the suction chamber with fluid, the cavitation tendency of the primary pump is reduced. Due to the larger dimensions of the suction chamber, the flow rate of the fluid required to fill the suction chamber is reduced. Particularly preferably, the angular range, over which the suction chamber of the primary pump extends, is at least 25%, at least 50%, at least 75%, or at least 100% greater than the angular range, over which the suction chamber of the main pump extends.

Additionally or alternatively, the pressure chamber of the primary pump, as seen in cross section, is at least as large as the pressure chamber of the main pump, i.e., it extends over at least the same angular range. In this case, it can naturally also be provided that the pressure chamber of the primary pump extends over a larger angular range than the pressure chamber of the main pump. Preferably, the angular range, over which the pressure chamber of the primary pump extends, is at least 10%, at least 20%, or at least 25% greater than the angular range, over which the pressure chamber of the main pump extends. This allows for the high speed of the primary pump described above.

A further embodiment of the invention provides that the suction chamber and the pressure chamber of the primary pump are directly fluidically connected to one another via an overflow valve. The overflow valve is configured such that it creates, and otherwise interrupts, a flow connection between the pressure chamber and the suction chamber when a specific pressure difference between the pressure chamber and the suction chamber is exceeded. In this respect, the overflow valve serves as a pressure relief valve which opens when a specific pressure difference between the pressure chamber and the suction chamber is reached or exceeded, so that the pressure present in the pressure chamber can be reduced in the direction of the suction chamber. The overflow valve closes as soon as the pressure difference between the pressure chamber and the suction chamber again falls below the specified pressure difference. The overflow valve can be integrated in the machine housing or arranged outside the machine housing. The overflow valve prevents a maximum pressure from being exceeded and/or the occurrence of cavitation in the primary pump, so that a reliable supply of fluid to the main pump is always ensured.

Within the scope of a further embodiment of the invention, it is provided that the angular range, over which the suction chamber of the primary pump configured as an internal gear pump extends in the circumferential direction, is at least 180°, at least 190°, at least 200°, at least 210°, at least 220°, or at least 225°. With such an extension of the suction chamber in the circumferential direction, a reliable filling of the suction chamber is achieved even at high speeds of the primary pump.

A development of the invention provides that a primary pump filler piece is arranged in the primary pump configured as an internal gear pump between the primary pump sprocket and the primary pump hollow wheel, and a main pump filler piece is arranged in the main pump between the main pump sprocket and the main pump hollow wheel, wherein the primary pump filler piece has a smaller angular extension in the circumferential direction with respect to a rotational axis of the primary pump sprocket than the main pump filler piece in the circumferential direction with respect to a rotational axis of the main pump sprocket. As already explained, the respective filler piece is used to fluidically separate the pressure chamber from the suction chamber. For this purpose, the filler piece bears against the respective sprocket and against the respective hollow wheel in a sealing manner as seen looking in the radial direction or in cross section. In order to achieve the largest possible extension of the suction chamber in the circumferential direction for the primary pump, the primary pump filler piece is configured with a smaller angular extension in the circumferential direction than the main pump filler piece. The angular extension of the respective filler piece refers to the angle with respect to the respective rotational axis of the sprocket. The described configuration of the filler pieces ensures a reliable filling of the suction chamber of the primary pump at high speeds.

A preferred further embodiment of the invention provides that the primary pump filler piece, the primary pump sprocket, and the primary pump hollow wheel are arranged and/or designed such that a sealing effect between the primary pump filler piece and the primary pump sprocket and/or a sealing effect between the primary pump filler piece and the primary pump hollow wheel on a side of the primary pump filler piece facing the pressure chamber is larger than on a side of the primary pump filler piece facing the suction chamber. The primary pump filler piece, as seen in cross section, bears in a sealing manner against the primary pump sprocket and against the primary pump hollow wheel. As seen looking in the circumferential direction, the sealing effect between the primary pump filler piece and the primary pump sprocket is greater on the side facing the pressure chamber than on the side facing the suction chamber. In particular, the sealing effect decreases, particularly steadily, in the circumferential direction starting from the pressure chamber in the direction of the suction chamber.

Additionally or alternatively, this applies to the sealing effect between the primary pump filler piece and the primary pump hollow wheel. The greater the contact pressure of the primary pump filler piece against the primary pump sprocket or the primary pump hollow wheel, the greater the sealing effect. Ultimately, this means that the contact pressure of the primary pump filler piece on the primary pump sprocket or the primary pump hollow wheel on the side of the primary pump filler piece facing the pressure chamber is greater than on the side facing the suction chamber, or that the contact pressure decreases, particularly steadily, starting from the side facing the pressure chamber in the direction of the side facing the suction chamber. This, in turn, allows for a particularly large design of the suction chamber of the primary pump with the advantages already described.

Within the scope of a further embodiment of the invention, it can be provided that, prior to start-up, the primary pump sprocket is designed to be oversized with respect to the primary pump filler piece and/or the primary pump hollow wheel is designed to be undersized with respect to the primary pump filler piece, so that a running-in wear occurs during running-in, resulting in a fit free of play. In other words, the primary pump sprocket or the primary pump hollow wheel are designed with a press fit with respect to the primary pump filler piece or, conversely, the primary pump filler piece is designed with a press fit with respect to the primary pump sprocket and/or the primary pump hollow wheel. When the fluid delivery device is put into operation, the running-in wear occurs, through which the primary pump sprocket, the primary pump hollow wheel and/or the primary pump filler piece are worn such that the fit free of play is subsequently present, which realizes a particularly high sealing effect. For this purpose, the primary pump filler piece is particularly preferably made of a softer material than the primary pump sprocket and the primary pump hollow wheel, so that the primary pump filler piece is essentially worn during running-in. Due to the fit free of play present after running-in, a particularly good sealing is achieved between the pressure chamber and the suction chamber of the primary pump, which, in turn, leads to high achievable pressures.

A further embodiment of the invention provides that the centrifugal pump has an impeller, wherein a diameter of the impeller has a maximum of 125% of an outer diameter of the main pump hollow wheel. The impeller is provided and designed to deliver the fluid. At its largest point in the radial direction, it has the diameter. Said diameter should be a maximum of 125% of the outer diameter of the main pump hollow wheel. The outer diameter describes the outer diameter of the main pump wheel at its largest point in the radial direction. It is preferably provided that the diameter of the impeller corresponds to, i.e., has the same size as, the outer diameter of the main pump hollow wheel. However, it can also be provided that the diameter of the impeller is maximally 90%, maximally 80%, or maximally 75% of the outer diameter of the main pump hollow wheel or is generally smaller. In this way, a compact design of the fluid delivery device is achieved.

Finally, within the scope of a further embodiment of the invention, it can be provided that the impeller of the centrifugal pump is arranged coaxially to the main pump sprocket. The impeller of the centrifugal pump can be driven via the primary pump input shaft, is particularly rigidly and/or permanently connected to it, for example, is integral with the primary pump input shaft. According to the above statements, the primary pump input shaft, to which the impeller of the centrifugal pump is present coaxially, can be integral with, and/or be made of the same material as, the main pump input shaft, to which the main pump sprocket is present coaxially. In this case, the impeller of the centrifugal pump and the main pump sprocket are preferably seated on the same shaft, namely the drive shaft of the fluid delivery device. This allows for a particularly advantageous coupling of the primary pump and the main pump.

Particularly preferably, it is provided that the diameter of the impeller of the centrifugal pump and/or a number of blades of the impeller, a pressure achievable by means of the centrifugal pump and/or a fluid throughput achievable by means of the centrifugal pump are selected such that a cavitation-free operation of the main pump is ensured. For this purpose, the impeller of the centrifugal pump is preferably configured accordingly.

BRIEF DESCRIPTION OF THE DRAWINGS

In the following, the invention shall be described in more detail using the embodiments shown in the drawings, without restricting the invention. In the drawings.

DETAILED DESCRIPTION

Figure 1:
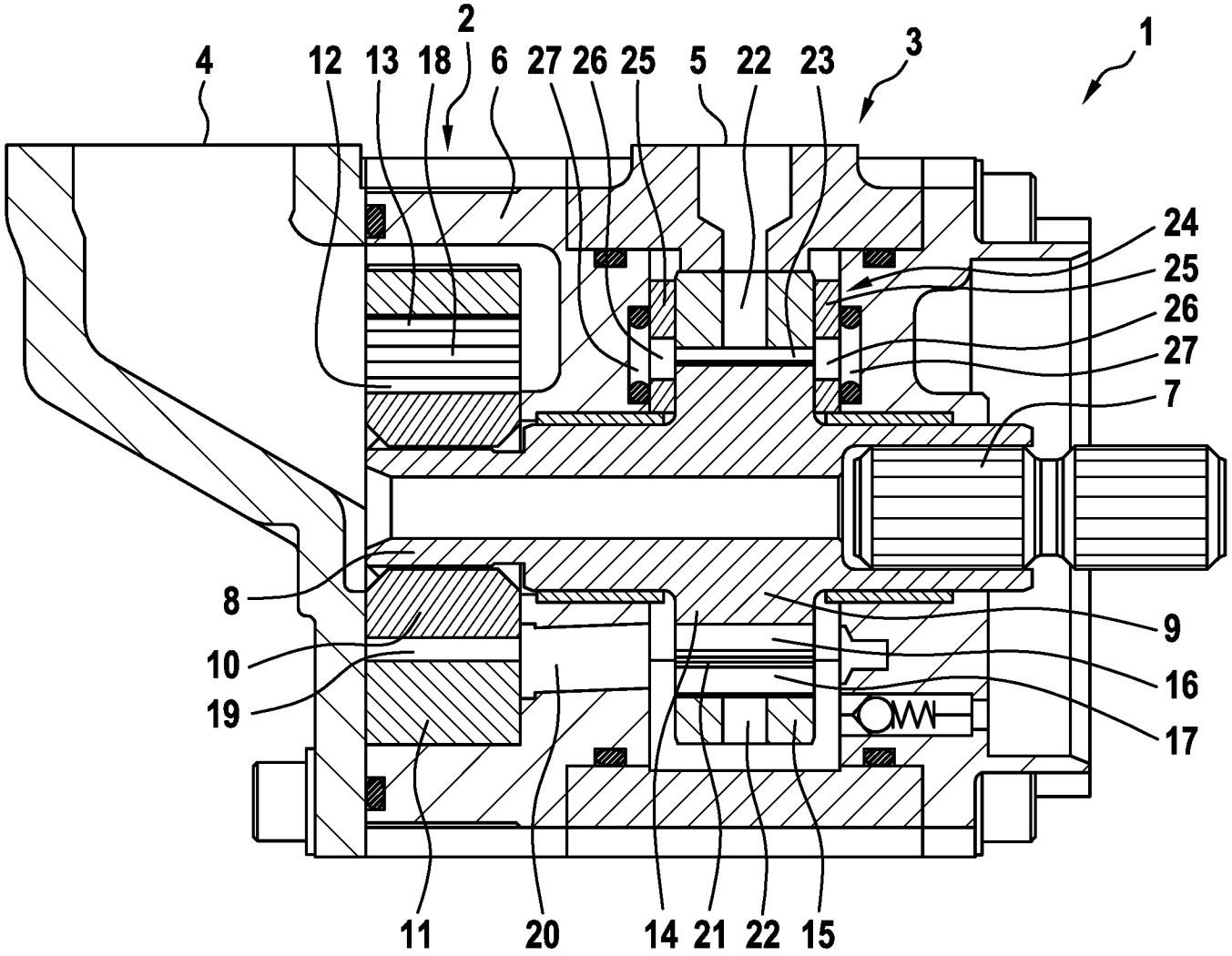
FIG. 1 shows a schematic longitudinal section of a fluid delivery device having a primary pump and a main pump.

FIG. 1 shows a schematic longitudinal section of a fluid delivery device 1 having a primary pump 2 and a main pump 3 fluidically connected to the primary pump 2. The fluid delivery device 1 has a fluid inlet 4 and a fluid outlet 5 and is configured such that it delivers fluid from the fluid inlet 4 in the direction of the fluid outlet 5. The primary pump 2 is directly fluidically connected to the fluid inlet 4, but only indirectly to the fluid outlet 5 via the main pump 3. Conversely, the main pump 3 is only indirectly connected to the fluid inlet 4 via the primary pump 2, but directly to the fluid outlet 5. This means that the fluid provided at the fluid inlet 4 is delivered by the primary pump 2 in the direction of the main pump 3 and from the main pump 3, it is delivered in the direction of the fluid outlet 5, where it is subsequently available.

The primary pump 2 and the main pump 3 are arranged in a common machine housing 6 or pump housing, on which both the fluid inlet 4 and the fluid outlet 5 are formed. A drive shaft 7, by means of which a primary pump input shaft 8 and a main pump input shaft 9 can be driven, is rotatably mounted in the machine housing 6. In the herein depicted embodiment, the primary pump input shaft 8 is integral with, and/or made of the same material as, the main pump input shaft 9. The drive shaft 7 is preferably non-rotatably coupled to the primary pump input shaft 8 and the main pump input shaft 9 via an interlocking connection, for example, a toothed connection. The primary pump 2 has a primary pump sprocket 10 and a primary pump hollow wheel 11 and is configured as an internal gear pump. In this respect, the primary pump sprocket 10 has an external toothing 12, which intermeshes in regions with an internal toothing 13 of the primary pump hollow wheel 11 for delivering the fluid. In the herein depicted embodiment, the primary pump sprocket 10 is non-rotatably connected to the primary pump input shaft 8, but it is movably connected in the axial direction. However, it can also be provided that the primary pump sprocket 10 is integral with, and/or made of the same material as, the primary pump input shaft 8. Alternatively, the primary pump 2 can be in the form of an external gear pump or a centrifugal pump.

The main pump 3 has a main pump sprocket 14 and a main pump hollow wheel 15. The main pump sprocket 14 has an external toothing 16 which, as seen looking in the circumferential direction, intermeshes only in regions with an internal toothing 17 of the main pump hollow wheel 15. In the primary pump 2, a suction chamber 18 is located in the radial direction between the primary pump sprocket 10 and the primary pump hollow wheel 11. This also applies to a pressure chamber 19. The suction chamber 18 is directly fluidically connected to the fluid inlet 4, wherein the primary pump 2 is configured such that the fluid, as seen looking in the axial direction, can flow into the suction chamber 18 on both sides. Accordingly, a flow connection is present from the fluid inlet 4 to both sides of the suction chamber 18. The pressure chamber 19 is fluidically connected to the main pump 3 via a flow channel 20 formed in the machine housing 6, i.e., it is connected to a suction chamber 21 of the main pump, which is located in the radial direction between the main pump sprocket 14 and the main pump hollow wheel 15.

The main pump 3 is configured such that the flow channel 20, as seen looking in the axial direction, is fluidically connected to the suction chamber 21 on both sides, so that fluid, as seen looking in the axial direction, can flow from the flow channel 20 on both sides into the suction chamber 21 of the main pump 3. In addition, recesses 22 are formed in the main pump hollow wheel 15, via which an additional flow connection between the flow channel 20 and the suction chamber 21 is present. The main pump 3 also has a pressure chamber 23 which is located in the radial direction between the main pump sprocket and the main pump hollow wheel 15. The pressure chamber 23 has, preferably exclusively, a flow connection to the fluid outlet 5 via the recesses 22. This means that fluid present in the pressure chamber 23 can escape from the pressure chamber 23 in the direction of the fluid outlet 5 exclusively via at least one of the recesses 22.

In the herein depicted embodiment, the main pump 3 is at least axially compensated, i.e., it has an axial compensation 24. For this purpose, as seen looking in the axial direction, one axial disk 25 each is arranged on both sides of the main pump sprocket 14 and the main pump hollow wheel 15, which are pushed in the direction of the main pump sprocket 14 and the main pump hollow wheel 15 during operation of the main pump 3 and bear in a sealing manner against the front sides of the main pump sprocket 14 and the main pump hollow wheel 15. For this purpose, pressure from the pressure chamber 23 of the main pump 3 is applied to the axial disks 25. For example, an opening 26 is formed for this purpose in the axial disks 25, via which the pressure chamber 23 is in flow connection with a pressure field 27 which is present on the side of the axial disk facing away from the pressure chamber 23.

Figure 2:
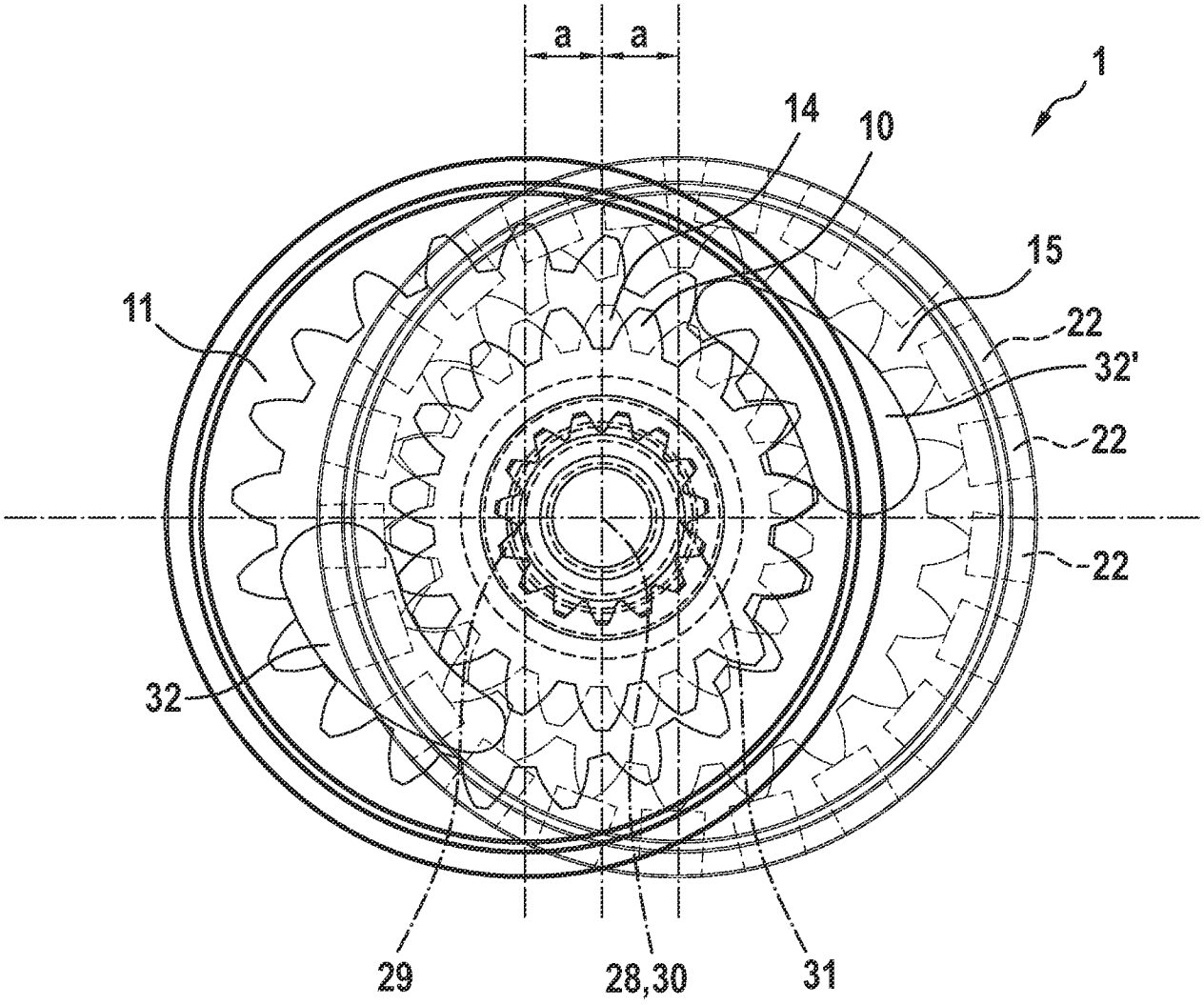
FIG. 2 is a schematic cross-sectional view of the fluid delivery device.

FIG. 2 is a schematic cross-sectional view of the fluid delivery device 1, wherein the primary pump sprocket 10, the primary pump hollow wheel 11, the main pump sprocket 14 and the main pump hollow wheel 15 are shown. The primary pump sprocket 10 is rotatably mounted about a rotational axis 28 of the primary pump sprocket, the primary pump hollow wheel 11 is rotatably mounted about a rotational axis 29 of the primary pump hollow wheel, the main pump sprocket 14 is rotatably mounted about a rotational axis 30 of the main pump sprocket, and the main pump hollow wheel 15 is rotatably mounted about a rotational axis 31 of the main pump hollow wheel. It can be seen that the rotational axis 28 of the primary pump sprocket and the rotational axis 30 of the main pump sprocket are identical, so that the primary pump sprocket 10 and the main pump sprocket 14 are arranged coaxially to one another. The rotational axis 29 of the primary pump hollow wheel is arranged at a distance parallel to the rotational axis 28 of the primary pump sprocket, and the rotational axis 31 of the main pump hollow wheel is arranged at a distance parallel to the rotational axis 30 of the main pump sprocket.

In the herein depicted embodiment of the fluid delivery device 1, the rotational axis 31 of the main pump hollow wheel and the rotational axis 29 of the primary pump hollow wheel are arranged on opposite sides of the rotational axis 28 of the primary pump sprocket. In other words, the rotational axis 28 of the primary pump sprocket, the rotational axis 29 of the primary pump hollow wheel, the rotational axis 30 of the main pump sprocket, and the rotational axis 31 of the main pump hollow wheel lie on an imaginary straight line, wherein the rotational axis 29 of the primary pump hollow wheel and the rotational axis 31 of the main pump hollow wheel are arranged on opposite sides of the rotational axis 28 of the primary pump sprocket and are particularly preferably arranged at the same distance a from it. It can be provided—as shown here—that teeth of the primary pump sprocket 10 and teeth of the main pump sprocket 14 are arranged offset from one another in the circumferential direction, i.e., as seen looking in the axial direction, they do not overlap and are not aligned with one another. As a result, the occurrence of pulsations can effectively be avoided. For example, an offset of half a tooth distance is provided, so that each tooth of the primary pump sprocket 10 lies centrally between two teeth of the main pump sprocket 14, or vice versa. However, any other offset in the circumferential direction can also be selected.

Figure 3:
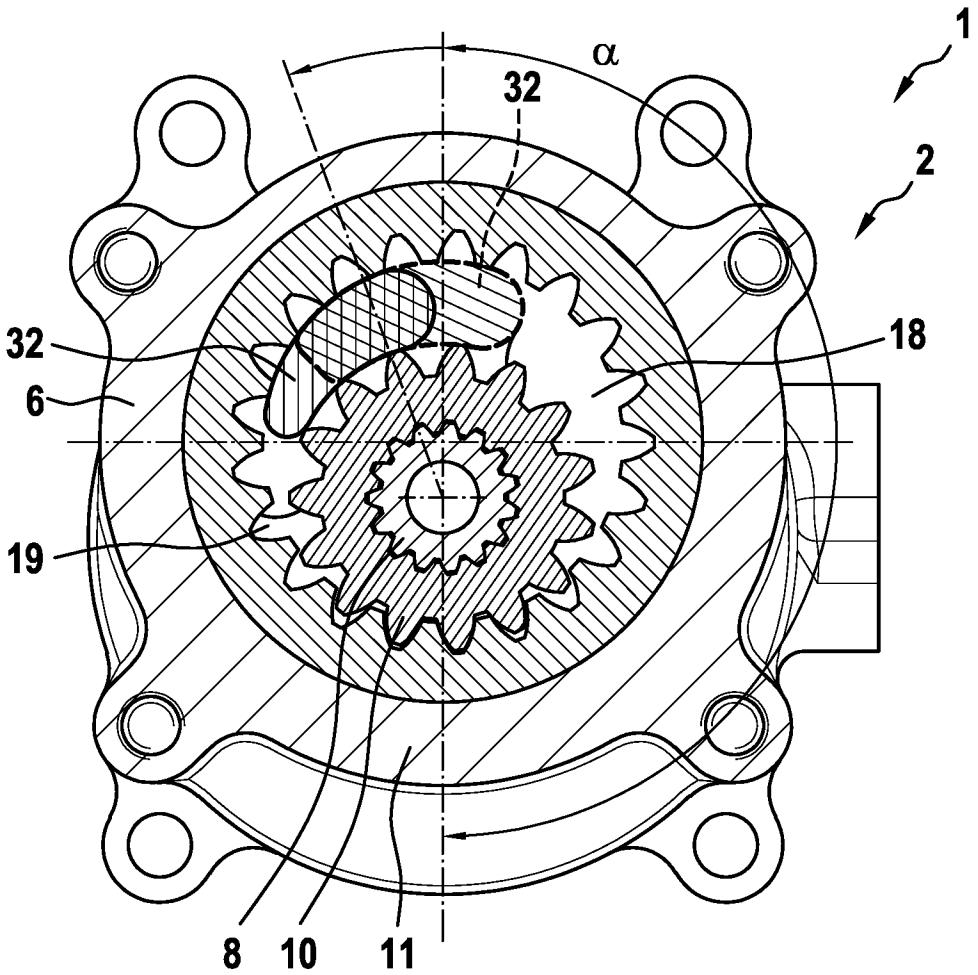
FIG. 3 is a schematic cross-sectional view of the fluid delivery device in the region of the primary pump.

FIG. 3 is a schematic cross-sectional view of the fluid delivery device 1 in the region of the primary pump 2. It shows the primary pump input shaft 8, the primary pump sprocket 10, and the primary pump hollow wheel 11, which are arranged in the machine housing 6. Between the primary pump sprocket 10 and the primary pump hollow wheel 11, a primary pump filler piece 32, shown herein in two different positions, is arranged for the fluidic separation of the suction chamber 18 from the pressure chamber 19. A main pump filler piece is shown at reference character 32'. It can be seen that the primary pump filler piece 32 has a comparatively small extension or angular extension in the circumferential direction. Correspondingly, the angular range a, over which the suction chamber 18 extends in the circumferential direction, is very large for both arrangements of the primary pump filler piece 32 and is at least 150°, preferably at least 180°, or more than 180°. As a result, a particularly rapid filling of the suction chamber 18 with fluid is ensured.

It is clear from the figures described that the primary pump 2 is configured to be non-compensated and, in the herein depicted embodiment, has neither an axial compensation nor a radial compensation. However, the main pump is configured to be compensated and, in the herein depicted embodiment, has at least the axial compensation 24. Additionally or alternatively, the main pump 3 can be designed with a radial compensation. The described configuration of the fluid delivery device 1 allows for a particularly high speed, particularly of the primary pump 2. This ensures a reliable supply of fluid to the main pump 3, so that overall the fluid delivery device 1 realizes a high delivery pressure or a large pressure ratio between the pressure at the fluid outlet 5 and the pressure at the fluid inlet 4.

Figure 4:
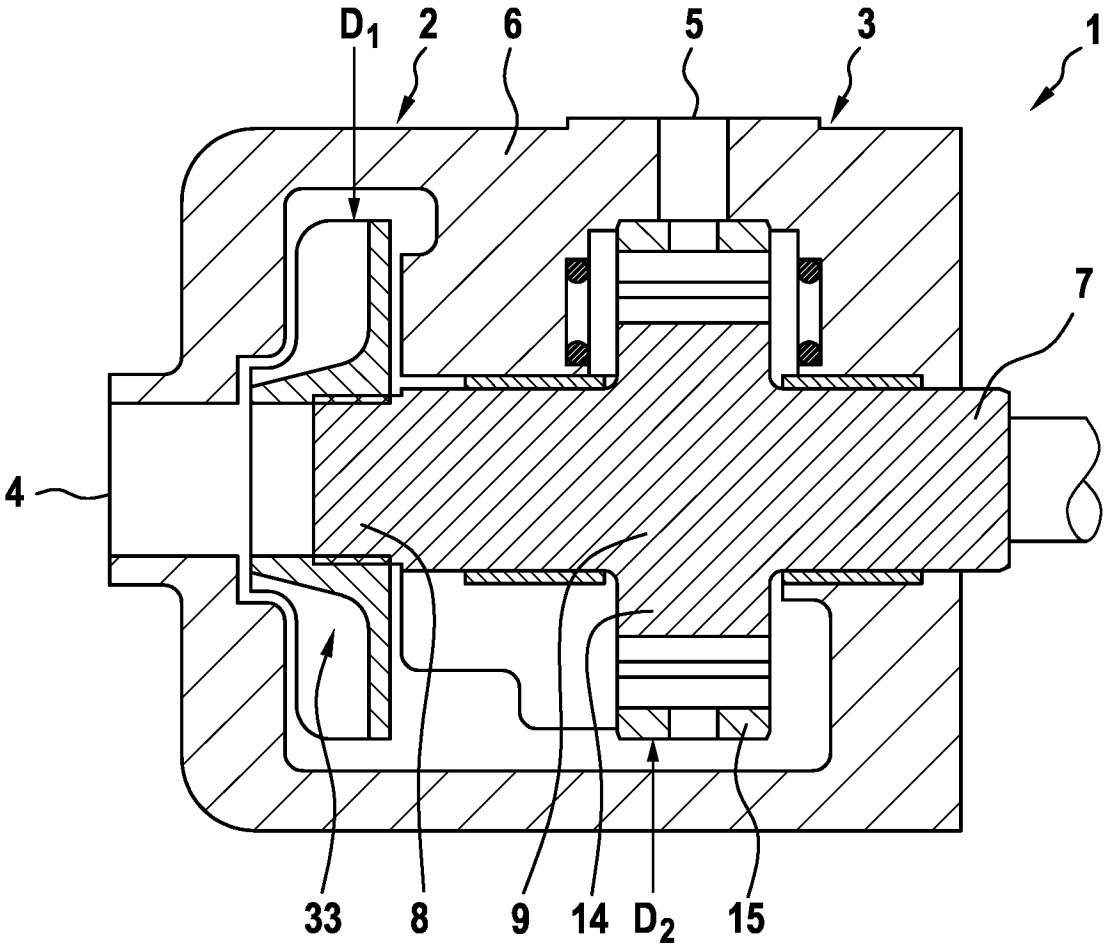
FIG. 4 shows a schematic longitudinal section of the fluid delivery device in a further embodiment.

FIG. 4 shows a schematic longitudinal section of the fluid delivery device 1 in a further embodiment. It corresponds in essential parts to the previously described fluid delivery device 1, so that reference is made to the corresponding statements and only the differences shall be described in the following. Said differences are that the primary pump 2 is not configured as an internal gear pump, but as a centrifugal pump. The primary pump 2, configured as a centrifugal pump, has an impeller 33, which in the herein depicted embodiment is present as a radial pump impeller. Accordingly, the centrifugal pump is configured as a radial pump. The impeller 33 has a diameter $D_1$ which, in the herein depicted embodiment, corresponds to an outer diameter $D_2$ of the main pump hollow wheel 15. In any case, however, the diameter $D_1$ of the impeller 33 corresponds to maximally 125% of the outer diameter $D_2$ of the main pump hollow wheel 15. It can be seen that the impeller 33 of the primary pump 2 is once again arranged coaxially to the main pump sprocket 14. As a result, a particularly compact design of the fluid delivery device 1 is achieved.

The invention claimed is:

1. A fluid delivery device comprising:

a primary pump driven by a primary pump input shaft; and a main pump fluidically connected to the primary pump, the main pump driven by a main pump input shaft, and the primary pump input shaft and the main pump input shaft are mechanically coupled to a common drive shaft of the fluid delivery device, wherein the primary pump is a non-compensated gear pump and the main pump is a compensated internal gear pump, wherein the primary pump has a higher limit speed and a larger pump volume than the main pump, wherein the primary pump, configured as an internal gear pump, includes at least one of:

a suction chamber that extends over an angular range larger than a suction chamber of the main pump; and a pressure chamber that extends over at least a same angular range as a pressure chamber of the main pump.

2. The fluid delivery device according to claim 1, wherein the primary pump has a primary pump sprocket and a primary pump hollow wheel, and the main pump has a main pump sprocket and a main pump hollow wheel, wherein the primary pump sprocket and the main pump sprocket are arranged coaxially and the primary pump hollow wheel and the main pump hollow wheel are arranged to be radially offset from one another.

3. The fluid delivery device according to claim 1, wherein the primary pump and the main pump are arranged in a common machine housing.

4. The fluid delivery device according to claim 1, wherein the angular range over which the suction chamber of the primary pump extends in a circumferential direction, is at least 180°.

5. The fluid delivery device according to claim 1, wherein the angular range over which the suction chamber of the primary pump extends in a circumferential direction, is at least 190°.

6. The fluid delivery device according to claim 1, wherein the angular range over which the suction chamber of the primary pump extends in a circumferential direction, is at least 200°.

7. The fluid delivery device according to claim 1, wherein the angular range over which the suction chamber of the primary pump extends in a circumferential direction, is at least 210°.

8. The fluid delivery device according to claim 1, wherein the angular range over which the suction chamber of the primary pump extends in a circumferential direction, is at least 220°.

9. The fluid delivery device according to claim 1, wherein the angular range over which the suction chamber of the primary pump extends in a circumferential direction, is at least 225°.

10. A fluid delivery device comprising:

a primary pump driven by a primary pump input shaft; and a main pump fluidically connected to the primary pump, the main pump driven by a main pump input shaft, and the primary pump input shaft and the main pump input shaft are mechanically coupled to a common drive shaft of the fluid delivery device, wherein the primary pump is a non-compensated gear pump and the main pump is a compensated internal gear pump, wherein the primary pump has a higher limit speed and a larger pump volume than the main pump, and wherein a primary pump filler piece is arranged in the primary pump configured as an internal gear pump between a primary pump sprocket and a primary pump hollow wheel, and a main pump filler piece is arranged in the main pump between a main pump sprocket and a main pump hollow wheel, wherein the primary pump filler piece has a smaller angular extension in a circumferential direction with respect to a rotational axis of the primary pump sprocket than the main pump filler piece in the circumferential direction with respect to a rotational axis of the main pump sprocket.

11. The fluid delivery device according to claim 10, wherein the primary pump filler piece, the primary pump sprocket, and the primary pump hollow wheel provide at least one of a sealing effect between the primary pump filler piece and the primary pump sprocket and a sealing effect between the primary pump filler piece and the primary pump hollow wheel on a side of the primary pump filler piece facing a pressure chamber is larger than on a side of the primary pump filler piece facing a suction chamber.

12. The fluid delivery device according to claim 10, wherein, prior to start-up, the primary pump sprocket is designed to be oversized with respect to the primary pump filler piece, so that a running-in wear occurs during running-in, resulting in a lit free of play.

13. The fluid delivery device according to claim 10, wherein, prior to start-up, the primary pump hollow wheel is designed to be undersized with respect to the primary pump filler piece, so that a running-in wear occurs during running-in, resulting in a fit free of play.

* * * * *